US005826420A

United States Patent [19]

Stahlecker

[11] Patent Number: 5,826,420

[45] Date of Patent: Oct. 27, 1998

[54] UPPER PART OF A SPINDLE AND METHOD OF MAKING SAME

[75] Inventor: Gerd Stahlecker, Eislingen/Fils, Germany

[73] Assignees: Fritz Stahlecker, Bad Uberkingen; Hans Stahlecker, Sussen, both of Germany

[21] Appl. No.: 780,163

[22] Filed: Dec. 24, 1996

[30] Foreign Application Priority Data

Jan. 13, 1996 [DE] Germany ..... 196 01 035.7

[51] Int. Cl.[6] ..... D01H 7/08

[52] U.S. Cl. ..... 57/135; 57/132

[58] Field of Search ..... 57/129, 130, 132, 57/135

[56] References Cited

U.S. PATENT DOCUMENTS

| | | | |
|---|---|---|---|
| 2,541,802 | 2/1951 | Wood | 57/130 |
| 2,668,087 | 2/1954 | Soussloff et al. | 57/130 |
| 2,775,859 | 1/1957 | Gleitz | 57/130 |
| 3,167,262 | 1/1965 | Adams et al. | 57/130 |
| 3,552,113 | 1/1971 | Staufert | 57/130 |
| 4,287,711 | 9/1981 | Hartmannsgruber et al. | 57/130 |
| 4,302,928 | 12/1981 | Stahlecker | 57/130 |
| 4,543,778 | 10/1985 | Koella, III et al. | 57/303 |
| 5,581,989 | 12/1996 | Mann et al. | 57/129 |

FOREIGN PATENT DOCUMENTS 29 13 500 A1 10/1980 Germany .

OTHER PUBLICATIONS

*Konstruktions–Praxis,* Nr. Apr. 1995, Vogel Verlag and Druck GmbH & Co. KG.

*Primary Examiner*—William Stryjewski

*Attorney, Agent, or Firm*—Evenson McKeown Edwards & Lenahan, PLLC

[57] ABSTRACT

An upper spindle part of a textile spindle for spinning or twisting machines comprises a sleeve made of a thin-walled metal tube and produced by cold press molding. A spindle shaft is inserted into the sleeve. The sleeve comprises a drive wharve formed in one piece therewith. The sleeve is produced by stretch forming and provided with at least one take-up surface for the insertable spindle shaft. The upper part of a spindle can thus be produced cost-effectively and with a high level of precision.

20 Claims, 1 Drawing Sheet

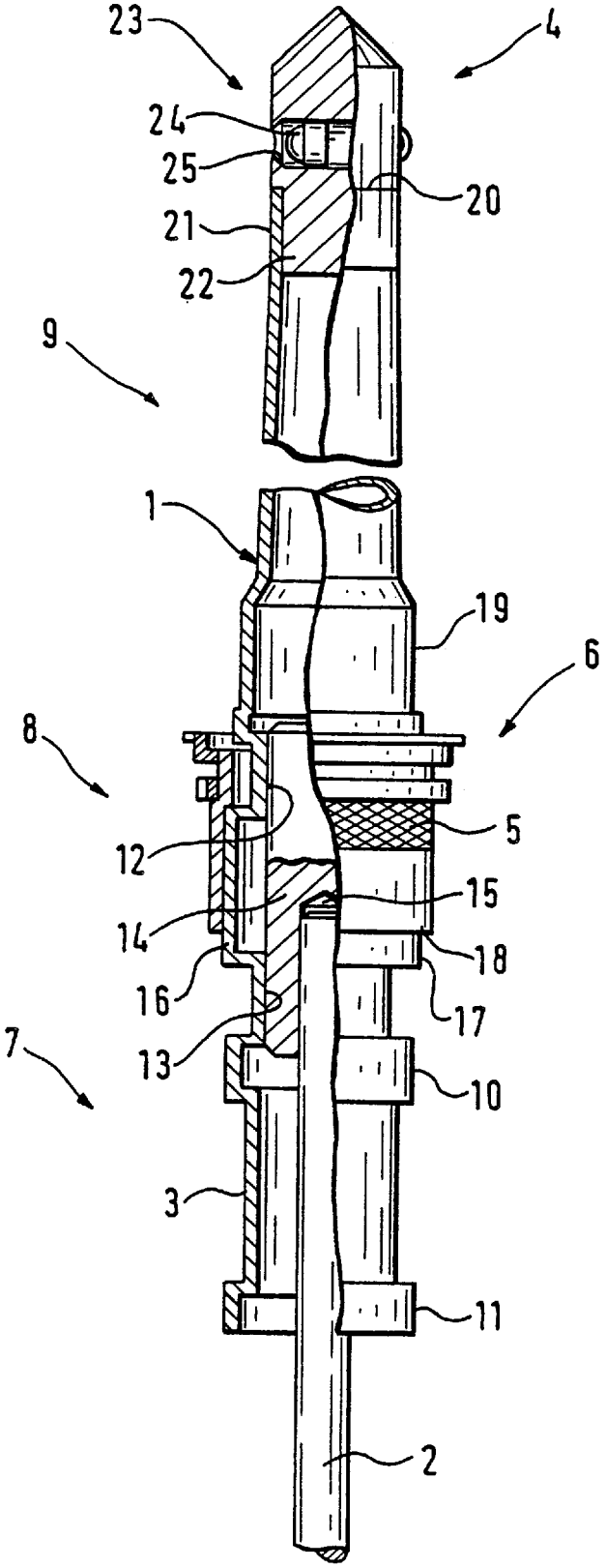
23
4
24
25
20
21
22
9
1
19
6
8
5
12
15
14
18
16
17
7
13
10
3
11
2

UPPER PART OF A SPINDLE AND METHOD OF MAKING SAME

BACKGROUND AND SUMMARY OF THE INVENTION

The present invention relates to an upper spindle part of a textile spindle for spinning or twisting machines comprising a sleeve made of a thin-walled metal tube and produced by cold press molding, which sleeve comprises a drive wharve formed in one piece therewith, and into which a spindle shaft is inserted.

It is known from U.S. published U.S. Pat. No. 4,287,711 that a sleeve with a one-piece drive wharve is produced by the cylindrical hammering method. A metal tube with a wall thickness of preferably 1.2. to 1.8 mm is used, the outer side of which is tooled in the cylindrical hammering process. The sleeve can be further tooled after the cylindrical hammering process, for example, it can be ground.

It is known from the special publication from *Konstruktions-Praxis,* Nr. 4/1995, published by Vogel Verlag und Druck GmbH & Co. KG, that hollow bodies with a desired contour are produced by means of hydrostatic stretch forming. A metal tube can be used as a blank, which is placed in a two-part form tool. Forming takes place in that active means, usually water, is fed under high pressure into the blank with the smaller circumference. Due to the high inner pressure, the blank expands until its outer side touches the inner surface of the form tool, thus attaining the desired outer contour.

It is an object of the present invention to provide an upper part for a spindle which comprises a sleeve with a drive wharve formed in one piece therewith, which is cost-effective and which can be produced with a high level of precision.

This object has been achieved in accordance with the present invention in that the sleeve is produced by means of stretch forming, preferably by hydrostatic stretch forming, and comprises at least one take-up surface for the insertable spindle shaft.

A metal tube is used as a blank for the production of the sleeve, which metal tube is formed from the inside. The different diameters of the various longitudinal sections of the sleeve are attained, not as in the cylindrical hammering process by compressing, but by stretching the material. While in the cylindrical hammering process, the largest possible diameter is determined by the diameter of the blank, in hydrostatic stretch forming, the smallest possible diameter is determined by the diameter of the blank.

According to the present invention, the longitudinal sections of the sleeve, which must be produced with a high level of precision and, as required, have a small diameter, can also be produced very easily. Such a longitudinal section can, for example, be the area of the drive wharve. In the cylindrical hammering process, a longitudinal section of this kind due to the compression required, had to be subsequently treated in order to achieve the necessary precision.

After assembly, the axis of the sleeve must be exactly flush with the axis of the spindle shaft. The sleeve is therefore provided with at least one take-up surface for the insertable spindle shaft. This take-up surface is produced in the hydrostatic stretch forming process with the necessary precision.

In an advantageous embodiment of the present invention, the sleeve has a smaller diameter in the area of the drive wharve than in other areas of its axial length. It is hereby possible that the area of the drive wharve is radially overtopped by projecting ring collars, other surfaces or by the take-up part for the bobbin tube. The latter can be the case, for example, when the upper part is intended for bobbin tubes with large inner diameters.

In a further advantageous embodiment, the sleeve is provided in the area of the take-up surface with a pressed-in insert, which is in turn connected to the spindle shaft. The pressed-in insert, in the area of the connecting point with the sleeve, enlarges the diameter of the spindle shaft. Thus a blank in the form of a metal tube with a larger diameter can be used.

The insert, into which the spindle shaft is pressed can be connected with the sleeve in various ways, for example, by press fit.

It is advantageous to weld the insert to the sleeve by laser. The inner diameter of the sleeve and the outer diameter of the pressed-in insert can be chosen so that the sleeve can be adjusted relative to the spindle shaft. After adjustment, the fixed position can be set permanently, in that the pressed-in insert and the sleeve are joined together by laser welding.

In an advantageous embodiment an insert is placed into the upper open front end of the sleeve, which insert comprises coupling means for a bobbin tube. The area of the upper front end of the sleeve can be produced in a simple way in that the insert comprising the coupling means can be easily inserted and, if required, be exchanged.

In an advantageous embodiment a double crown with an underwinding surface is pressed onto the sleeve. It is possible hereby to apply in a simple way an underwinding surface with a desired surface structure to the upper part of the spindle without any forming of the sleeve itself.

BRIEF DESCRIPTION OF THE DRAWING

These and further objects, features and advantages of the present invention will become more readily apparent from the following detailed description thereof when taken in conjunction with the accompanying drawing.

The single drawing FIGURE shows a partly cutaway longitudinal view of a spindle upper part.

DETAILED DESCRIPTION OF THE DRAWING

The upper part of a spindle for a ring spinning machine shown in the drawing FIGURE comprises a sleeve 1, into which a spindle shaft 2 is inserted. A drive wharve 3 is formed onto the sleeve 1 in one piece. At its upper end, the upper part of the spindle is provided with a tube coupling 4 for holding a bobbin tube (not shown). The upper part of the spindle has in addition an underwinding surface 5 and a double crown 6, over which the yarn is guided to the underwinding surface 5 after the bobbin tube has been filled.

The spindle shaft 2 is supported in a spindle housing (not shown) and is set in rotation together with the upper part of the spindle by a drive belt (not shown) disposed on the drive wharve 3.

As can be seen from the drawing FIGURE, the sleeve 1 has various diameters along its axial length. The sleeve 1 with its varying diameters is made from a metal tube, preferably of steel, formed by hydrostatic stretch forming. It has a high dimensional exactness which is maintained alone by the hydrostatic stretch forming, without any subsequent finishing. As hydrostatic stretch forming is in itself a known process, it requires no further explanation here.

In order to simplify matters, the sleeve 1 is divided in the following description into a lower longitudinal section 7, a middle longitudinal section 8 and an upper longitudinal section 9.

The lower longitudinal section 7 comprises the drive wharve 3, which is bordered on both sides by ring collars 10,11. The collar 11 serves as a brake collar for a spindle brake (not shown). The diameter of the drive wharve 3 is relatively small in order to permit low speeds of the drive belt. In the area of the drive wharve 3, accurate finishing plays an important role, as different sizes of diameter of the drive wharve 3 lead to different rotational speeds of the spindles and thus to different spinning results in a spinning machine. The necessary finishing accuracy is obtained also in the area of the drive wharve 3 by hydrostatic stretch forming without the need for any further machining. The forming-out of both ring collars 10,11 directly bordering the drive wharve 3 presents no problems either.

The middle longitudinal section 8 contains areas with varying diameters. The areas with smaller diameters form take-up surfaces 12,13 on their inner circumferences for a pressed-in insert 14 to which the spindle shaft 2 is connected. The spindle shaft 2 is taken up by a location bore hole 15 of the insert 14 by means of press fit. The insert 14 and the take-up surfaces 12,13 are adapted to each other with respect to their diameters in such a way that the sleeve 1 can be adjusted relative to the spindle shaft 2. After adjustment, the insert 14 on the take-up surfaces 12,13 is joined to the sleeve 1 by means of laser welding.

Between the take-up surfaces 12 and 13 of the middle longitudinal section 8, the sleeve 1 has an area 16 with an enlarged diameter. A tube-like support 18, which comprises the knurled underwinding surface 5 and the double crown 6, is pressed onto the outer circumference 17 of the area 16. The double crown 6 has in a known way an upper groove ring, a lower groove ring and a blade, which are secured onto the tube-like support 18 and which are exchangeable.

The upper longitudinal section 9 of the sleeve 1 takes up the bobbin tube. The diameter of the longitudinal section 9 depends on the inner diameter of the bobbin tube. The diameter of the longitudinal section which takes up the bobbin tube can be larger or smaller than the diameter of the drive wharve 3.

In the embodiment shown in the drawing FIGURE, in the upper longitudinal section 9 of the sleeve 1, the diameter in the area 19 adjoining the double crown 6 is somewhat larger than the diameter of the drive wharve 3. The diameter of the sleeve 1 in the named area 19 corresponds approximately to the inner diameter of the bobbin tube which is taken up. The sleeve 1 extends at first conically in the upper longitudinal section 9 in the direction towards the spindle tip and finishes at the upper front end 20 in a cylindrical area 21. The tube coupling 4 is inserted with an insert 22 into this cylindrical area 21 of the sleeve 1. The insert 22 is held by a light press fit in the cylindrical area 21.

It would also be possible according to the invention to connect the insert 22 with the sleeve 1 by means of laser welding.

The tube coupling 4 with the insert 22 is formed as a centrifugal coupling. The insert 22 comprises coupling means 23, which are arranged outside of the sleeve 1.

It would also be possible according to the invention to construct the insert 22 so that the coupling means are arranged inside the sleeve 1.

As can be seen from the drawing FIGURE, the coupling means contained in the insert 22 are formed by mass elements 24 and radial guides 25. The mass elements 24 are freely movable inside of the radial guides 25 and are driven outwards when the spindle is rotated until they are stopped by the bobbin tube or by other stopping surfaces (not shown) of the tube coupling 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An upper spindle part for a textile spindle for spinning or twisting machines, comprising:

a sleeve made from a thin-walled metal tube, and a spindle shaft inserted into said sleeve, wherein the sleeve is cold stretch formed in one piece with a sufficient level of precision dimensioning of a drive wharve and a spindle shaft accommodating internal receiving surface so that further surface treatment of said drive wharve and receiving surface are unnecessary.

2. An upper spindle part according to claim 1, wherein the drive wharve is bordered by integral ring collars of said sleeve.

3. An upper spindle part according to claim 2, comprising a pressed-in insert engaging the receiving surface, which insert is in turn connected to the spindle shaft.

4. An upper spindle part according to claim 3, wherein the insert is connected to the sleeve by means of laser welding.

5. An upper spindle part according to claim 4, wherein a second insert is inserted in an upper open end of the sleeve, said second insert, comprising a coupler for a bobbin tube.

6. An upper spindle part according to claim 3, wherein a second insert is inserted in an upper open end of the sleeve, said second insert comprising a coupler for a bobbin tube.

7. An upper spindle part according to claim 3, wherein a double crown with an underwinding surface is pressed onto the sleeve.

8. An upper spindle part according to claim 2, wherein a double crown with an underwinding surface is pressed onto the sleeve.

9. An upper spindle part according to claim 1, comprising a pressed-in insert engaging the receiving surface, which insert is in turn connected to the spindle shaft.

10. An upper spindle part according to claim 9, wherein the insert is connected to the sleeve by means of laser welding.

11. An upper spindle part according to claim 10, wherein a double crown with an underwinding surface i pressed onto the sleeve.

12. An upper spindle part according to claim 9, wherein a second insert is inserted in an upper open end of the sleeve, said second insert comprising a coupler for a bobbin tube.

13. An upper spindle part according to claim 12, wherein a double crown with an underwinding surface is pressed onto the sleeve.

14. An upper spindle part according to claim 1, wherein a double crown with an underwinding surface is pressed onto the sleeve.

15. A method of making an upper spindle part for a textile spindle for spinning or twisting machines, comprising:

cold stretch forming a sleeve from a thin-walled metal tube, and inserting a spindle shaft into said sleeve, wherein said cold stretch forming of the sleeve includes forming a spindle drive wharve and at least one spindle shaft accommodating internal receiving surface with sufficiently precise dimensions so that further surface treatments of the drive wharve and at least one receiving surface are unnecessary.

16. A method according to claim 15, wherein said cold stretch forming includes forming ring collars which border the drive wharve.

17. A method according to claim 15, comprising pressing in an insert for the spindle shaft into said at least one receiving surface and connecting said insert to the sleeve by laser welding.

18. A method according to claim 17, comprising inserting a second insert into said sleeve at an upper open end of said sleeve facing away from the spindle shaft, said second insert comprising a coupler for a bobbin tube.

19. A method according to claim 15, wherein said cold stretch forming includes hydrostatic stretch forming using hydrostatic pressure inside said sleeve.

20. A method according to claim 15, wherein a double crown with an underwinding surface is pressed onto the sleeve.

* * * * *